United States Patent [19]

Chadwick

[11] 4,212,593

[45] Jul. 15, 1980

[54] HEAT-POWERED WATER PUMP

[75] Inventor: Duane G. Chadwick, Logan, Utah

[73] Assignee: Utah State University Foundation, Logan, Utah

[21] Appl. No.: 6,319

[22] Filed: Jan. 25, 1979

[51] Int. Cl.[3] ..... F04B 19/24

[52] U.S. Cl. ..... 417/53; 417/209

[58] Field of Search ..... 417/53, 207, 208, 209, 417/149, 52

[56] References Cited

U.S. PATENT DOCUMENTS

| | | | |
|---|---|---|---|
| 135,765 | 2/1873 | Brock | 417/209 |
| 2,050,391 | 8/1936 | Spencer | 417/52 |
| 2,553,817 | 5/1951 | Af Kleen | 417/52 |
| 2,688,922 | 9/1954 | Bonaventura | 417/52 |
| 2,744,470 | 5/1956 | Coleman | 417/209 |
| 2,757,618 | 8/1956 | Af Kleen | 417/209 |
| 2,954,741 | 10/1960 | Af Kleen | 417/209 |
| 2,973,715 | 3/1961 | MacCracken | 417/52 |
| 3,659,960 | 5/1972 | Dunlop | 417/52 |
| 3,765,799 | 10/1973 | Ledner | 417/53 |
| 3,790,305 | 2/1974 | Ledner | 417/53 |
| 3,819,301 | 6/1974 | Jaster | 417/209 |
| 3,834,835 | 9/1974 | Jaster | 417/209 |

*Primary Examiner*—Billy J. Wilhite

*Attorney, Agent, or Firm*—J. Winslow Young; H. Ross Workman; Rick D. Nydegger

[57] ABSTRACT

A heat-powered water pump apparatus and method, the apparatus including a reservoir, a pumping chamber, an evaporator, metering apparatus for metering a volatile liquid to the evaporator and a vapor standpipe for delivering vapor from the evaporator to the pumping chamber. The metering apparatus includes a metering cup and a siphon tube in the metering cup. The evaporator is configurated as a metal block having known heat capacity characteristics so as to store sufficient thermal energy to suitably evaporate the metered volatile liquid delivered thereto. Thermal energy for the evaporator may be provided by solar energy or by a conventional combustion source. The method includes heating the evaporator and delivering a metered quantity of volatile liquid from the pumping chamber to the evaporator to produce a predetermined quantity of vapor thereby displacing water from the reservoir with the vapor.

26 Claims, 1 Drawing Figure

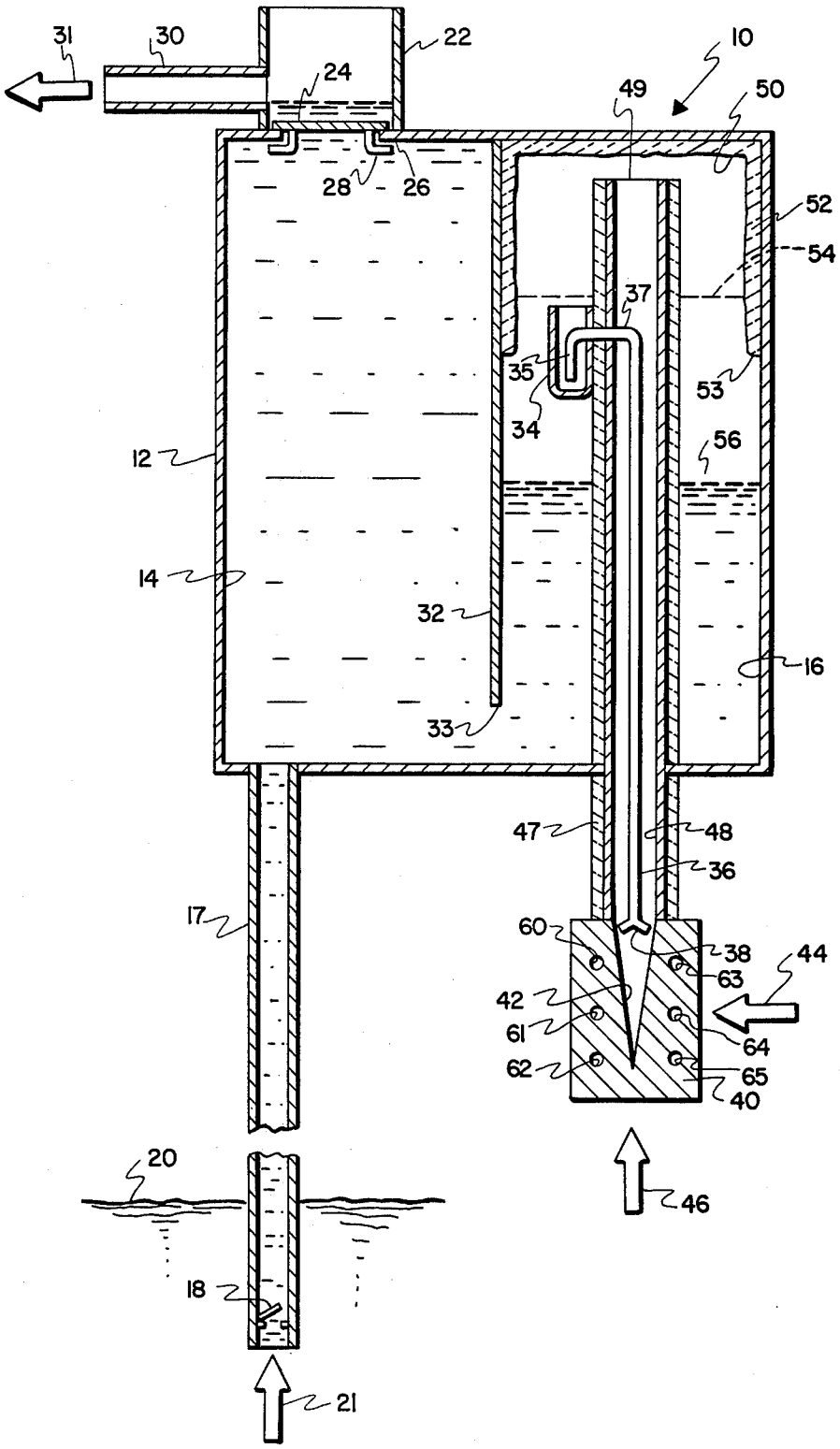
31
30
22
24
10
49
50
28
26
52
54
37
35
53
34
56
12
14
32
16
33
47
48
36
17
60
38
44
63
42
61
64
62
65
40
20
46
18
21

HEAT-POWERED WATER PUMP

BACKGROUND

1. Field of the Invention

This invention relates to water pumps and, more particularly, to heat-powered water pumps.

2. The Prior Art

Throughout the world there are many places where fuel and electrical power are expensive because of limited fossil fuel deposits, transportation difficulties and locations remote from electrical generating stations. Furthermore, the local production of electrical energy by combustion engines is expensive when considering the costs associated with the initial equipment purchase, fuel, transportation of the fuel, repairs and the need for a relatively high degree of technical sophistication for the repairs. In addition, projected fossil fuel shortages will result in continually increasing fuel costs.

However, a relatively cheap and abundant energy source is necessary for a high material standard of living. It is only when humanity can multiply mechanical work many times beyond muscle power that enough goods and services can be produced to provide the economic conditions for a reasonably satisfactory standard of living. Although fuel and energy are reasonably available and at a relatively reasonable cost in the currently industrialized areas of the world, in the remote areas of the world the relatively high cost for fuel and energy, particularly electrical energy, substantially inhibits the further development of those portions of the world. For example, vast areas of the world are suitable for irrigation with relatively abundant sources of water being relatively readily available. However, these areas also require an economical technique for raising the water from the relatively shallow water table or nearby stream to the surface for irrigation. Most primitive devices for lifting this water includes simple devices operated by one or two men or through the use of animal energy. However, the use of manpower to pump water is particularly wasteful of man's labor since man's labor can be more economically utilized in providing goods and services rather than mechanical energy. Furthermore, animals also consume food grown on irrigated land, part of which might otherwise be used for human consumption.

Coincidentially, although there are many parts of the world where fuel and electrical power are expensive because of long distances from the natural deposit, transportation difficulties etc., these locations are also generally endowed with an abundance of available solar energy. Currently, the only inexhaustable source of energy available is solar energy. Solar energy or solar flux is customarily measured in langleys per minute, one langley being equivalent to one calorie of radiation energy per square centimeter. The intensity of the solar flux varies with geographical location, time of day, season, cloud cover, atmospheric dust, and the like. This intensity varies between about 0 and 1.5 calories per square centimeter per minute. Therefore, assuming a solar flux of one langley per minute, a one square meter surface receives 10,000 calories per minute. With an overall average of one langley per minute for 500 minutes per day (which is slightly more than 8 hours), a 100 square meter surface receives, in bright sunshine, about 500,000 kilocalories per day. This energy is the equivalent in thermal energy to burning about 14 gallons of gasoline.

Accordingly, on a comparative basis, solar energy does appear to be feasible in providing the necessary energy for the efficient pumping of water. Although solar energy is produced only while the sun is shining, pumping irrigation water, which involves no storage of power, offers a good area for the early use of solar energy. For those times when the sun is not shining, substitute thermal energy could be obtained from burning agricultural wastes such as stubble, weeds, chaff and the like. In these situations, the economic comparisons between solar energy and other energy sources appear to be sufficiently advantageous to encourage further research and development of solar energy.

Additional information regarding solar applications can be found in APPLIED SOLAR ENERGY, Adden B. Meinel and Marjorie P. Meinel, Addison-Westley Publishing Company, Reading, Massachusetts (1976) Library of Congress Catalog Card No. 75-40904, and DIRECT USE OF THE SUN'S ENERGY, Farrington Daniels, Ballantine Books, New York (1977) Library of Congress Catalog Card No. 64-20913.

Various types of water or fluid pumps operable from heat sources are shown in U.S. Pat. Nos. 2,050,391; 2,553,817; 2,688,922; 2,744,470; 2,757,618; 2,954,741; 2,973,715; 3,659,960; 3,765,799; and 3,790,305. However, the devices represented in each of the foregoing patents tend to be rather complex, expensive to fabricate and maintain, or require excessive monitoring for efficient utilization of energy. Each of these factors restrict the use of these devices in the less developed sections of the world.

In view of the foregoing, it would, therefore, be an advancement in the art to provide a heat-powered water pump which is operable to pump water from a relatively shallow location to an elevated location, the pump operating relatively independently of continuous monitoring and maintenance. In addition, it would be an advancement in the art to provide a heat-powered water pump which can utilize either solar energy or thermal energy from burning agricultural wastes. Such an invention is disclosed and claimed herein.

BRIEF SUMMARY AND OBJECTS OF THE INVENTION

The present invention relates to a novel heat-powered water pump and method, the water pump being relatively simple in construction and readily adaptable to inexpensively pump water at a remote location with a minimal amount of maintenance and/or monitoring. Either solar energy or the combustion of agricultural wastes may be used to supply thermal energy to vaporize a metered quantity of volatile liquid in an evaporator. The vapor thus produced is delivered to a pumping chamber where it expands and pushes downwardly on the liquid surface thereby expelling water from the adjacent reservoir through a check valve. Condensation of the vapor produces a partial vacuum in the pumping chamber closing the outlet check valve and opening an inlet check valve immersed in a water source thereby causing the reservoir to refill and the liquid level in the pumping chamber to again rise. The rising level of liquid in the pumping chamber refills a metering cup so that a siphon tube cyclically drains the metering cup and delivers metered volatile liquid to the evaporator for repeating the foregoing pumping cycle. The evaporator stores sufficient thermal energy between stages to evaporate the metered volatile liquid.

It is, therefore, a primary object of this invention to provide improvements in heat-powered water pumps.

Another object of this invention is to provide improvements in the method of pumping water with a heat-powered water pump.

Another object of this invention is to provide a heat-powered water pump which cyclically pumps water from a relatively shallow location to an elevated location.

Another object of this invention is to provide a heat-powered water pump wherein the working fluid includes a volatile liquid that is less dense than water and also immiscible with water.

Another object of this invention is to provide a heat-powered water pump wherein the working fluid for the pump may be supplied from the water being pumped.

These and other objects and features of the present invention will become more fully apparent from the following description and appended claims taken in conjunction with the accompanying drawing.

BRIEF DESCRIPTION OF THE DRAWING

The drawing is a schematic illustration of the heat-powered water pump of this invention.

DETAILED DESCRIPTION OF THE PREFERRED EMBODIMENT

The invention is best understood by reference to the drawing wherein like parts are designated with like numerals throughout.

With particular reference to the drawing, the heat-powered water pump of this invention is shown generally at 10 and includes a vessel 12 segregated into a reservoir 14 and a pumping chamber 16 by a downwardly depending divider 32. The bottom of divider 32 terminates at an edge 33 spaced from the bottom of vessel 12 thereby providing fluid communication between reservoir 14 and pumping chamber 16. An inlet pipe 17 directs water 21 from a water source 20 through an inlet check valve 18 into reservoir 14. Discharged water 31 is expelled from reservoir 14 through outlet check valve 24 into a surge chamber 22 which is drained by an outlet conduit 30.

Check valve 24 is configurated as an enlarged, planar element fabricated from sheet metal or the like and is adapted to rest upon a valve seat 26. Check valve 24 is inhibited from excessive upward movement by fingers 28 extending below valve seat 26. A small hydrostratic head of water in surge chamber 22 below outlet conduit 30 overlays outlet check valve 24 thereby providing an appropriate downward force to assist in sealing outlet check valve 24 against valve seat 26.

A standpipe 48 passes upwardly through pumping chamber 16 and terminates in an open end 49 spaced from the top surface of pumping chamber 16. The lower end of standpipe 48 terminates in an evaporator 40 and provides a passageway for directing vapor generated in evaporator 40 into pumping chamber 16. A metering cup 34 inside pumping chamber 16 is mounted to standpipe 48 a predetermined distance from the upper end. A metering tube 36 having an inverted J configuration with a downwardly depending arm 35 is immersed in metering cup 34. Metering tube 36 terminates at its lower end in a Y-shaped dispenser 38 at evaporator 40.

Evaporator 40 is configurated as a block having a V-shaped evaporation zone formed therein. Evaporator 40 is fabricated from a suitable material such as a metal (aluminum, copper, etc.) having a relatively high degree of thermal conductivity and heat capacity. The dimensions of evaporator 40 are selectively predetermined so as to provide the necessary heat storage capability for evaporation of the volatile liquid distributed therein through distributor 38.

Heat or thermal energy may be supplied either as solar energy indicated schematically at 44 or thermal energy indicated schematically at 46 from a combustion source (not shown). In either condition, the material of evaporator 44 absorbs or otherwise stores thermal energy and transfers the same to any volatile liquid distributed on surface 42 by distributor 38. Additionally thermal energy can also be supplied to evaporator 40 through bores 60–65. For example, steam from a remote source (not shown) such as a solar collector, boiler, or the like may be directed through bores 60–65 thereby transferring thermal energy to evaporator 40.

Insulation 47 surrounds the external surface of standpipe 48 to reduce the tendancy for vapor therein to condense by exchanging thermal energy with the surrounding water in pumping chamber 16. Vapor leaving exit 49 is also isolated against heat loss by insulation 52 on the surfaces of the upper end of pumping chamber 16. Insulation 52 terminates at a lower edge 53 to thereby expose the lower portion of divider 32 and the external walls of pumping chamber 16 to heat loss thereby assisting in the condensation of vapor at the end of the pumping cycle. For example, vapor from exit 49 of standpipe 48 enters an expansion chamber 50 of pumping chamber 16 and pushes downwardly on surface 54. Water below surface 54 in expansion chamber 50 is displaced downwardly to a position generally indicated at surface 56. This downward displacement correspondingly displaces water underneath edge 33 of divider 32 so as to displace an equal volume of water from reservoir 14 through check valve 24.

Condensation of vapor in expansion chamber 50 is assisted by thermal contact with the exposed portion of divider 32 below insulation 52 and also with the vapor/-liquid interface of level 56. Condensation of vapor in expansion chamber 50 creates a partial vacuum so that atmospheric pressure pushing downwardly on water surface 20 forces water 21 upwardly through check valve 18 into reservoir 14 and pumping chamber 16. The rising level 56 of volatile liquid eventually overflows the upper rim of metering cup 34 until the water level therein reaches the height of bend 37 in metering tube 36. At this time, volatile liquid flows through metering tube 36 and is dispersed into flash evaporator 40 by dispenser 38. The initiation of flow through siphon tube 36 also creates a siphon action that siphons the remainder of volatile liquid from metering cup 34. Metering cup 34 thereby provides the appropriate metering action for delivering a predetermined quantity of volatile liquid to evaporator 40. The metered volatile liquid is turned into vapor in evaporator 40 to again create a higher pressure within expansion chamber 50. The higher pressure forces level 56 downwardly thereby isolating metering cup 34 from any further incoming volatile liquid.

While pumping chamber 16 is shown in juxtaposition with reservoir 14 separated only by divider 32, each of these chambers may be separated by a discrete distance with a conduit suitably interconnecting them. However, the present configuration is believed preferable since water in reservoir 14 absorbs thermal energy released upon condensation of the vapor in pumping chamber 16 and transferred through divider 32 below insulation 52.

Throughout the foregoing specification, the working fluid for the vaporization/condensation cycle of this heat-powered water pump has been referred to as a volatile liquid. Representative examples of suitable volatile liquids include cyclopentane, hexane, and the like. In each instance, the non-water volatile liquid should be less dense than water and immiscible with the water in pumping chamber 16 so as to form a discrete layer on the water. Clearly, however, the water in pumping chamber 16 may provide the necessary volatile liquid for delivery to evaporator 40 thereby producing steam as the working vapor. In either circumstance, thermal energy produces vapor which upon expansion displaces water from reservoir 14 and upon condensation creates a partial vacuum to allow atmospheric pressure to force replacement water into reservoir 14.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a United States Letters Patent is:

1. A heat-powered water pump comprising:

a pumping chamber;

a reservoir chamber in fluid communication with the pumping chamber;

water inlet means for introducing water into the reservoir chamber;

water outlet means including an outlet check valve means for discharging water from the reservoir chamber;

vaporization means for vaporizing a volatile liquid to create vapor pressure to expel water from the pumping chamber and, correspondingly, from the reservoir chamber, the expelled water being discharged through the outlet check valve means;

metering means for metering the amount of volatile liquid delivered to the vaporization means; and condensation means for condensing the vapor generated by the vaporization means.

2. The heat-powered water pump defined in claim 1 wherein the water outlet means comprises an upwardly oriented surge chamber superimposed over said outlet check valve means and the outlet check valve means comprises a horizontally disposed valve body adapted to rest under gravity on a valve seat, the surge chamber holding a residual amount of water over the valve body thereby assisting in sealing the valve body to the valve seat.

3. The heat-powered water pump defined in claim 1 wherein the pumping chamber comprises a downwardly opening enclosure, the opening providing fluid communication with the reservoir chamber.

4. The heat-powered water pump defined in claim 3 wherein the enclosure further comprises an insulative layer on the upper surfaces of the pumping chamber.

5. The heat-powered water pump defined in claim 1 wherein the vaporizing means comprises a heat storage means.

6. The heat-powered water pump defined in claim 5 wherein the heat storage means comprises a block of metal with a cavity formed therein for receipt of volatile liquid from the metering means.

7. The heat-powered water pump defined in claim 6 wherein the metering means comprises a distributor for distributing volatile liquid to the surface of the cavity.

8. The heat-powdered water pump defined in claim 5 wherein the heat storage means is spaced from the pumping chamber and is adapted to be placed in thermal contact with a heat source.

9. The heat-powered water pump defined in claim 1 wherein the metering means comprises a metering cup and a siphon tube, the metering cup being mounted inside the pumping chamber adjacent the upper end thereof with the siphon tube inserted in the metering cup so as to drain the metering cup of volatile liquid upon filling of the metering cup to a level above the siphon tube, the siphon tube directing the siphoned volatile liquid to the vaporizing means.

10. The heat-powered water pump defined in claim 9 wherein the vaporizing means includes a standpipe means for directing the vapor from the vaporizing means to the pumping chamber.

11. The heat-powered water pump defined in claim 10 wherein the metering cup is mounted to the standpipe means and the siphon tube passes through the standpipe means to the vaporizing means.

12. The heat-powered water pump defined in claim 10 wherein the standpipe means comprises a vertically oriented pipe extending between the upper end of the pumping chamber and the vaporizing means.

13. A heat-powered water pump comprising:

a pumping reservoir;

inlet means for directing water into the pumping reservoir, the inlet means including a first check valve means to control the direction of flow of said water into the pumping reservoir;

outlet means for directing water from the pumping reservoir, the outlet means including a second check valve means to control the direction of flow of said water from the pumping reservoir;

a pumping chamber in fluid communication with the pumping reservoir;

vaporizing means for producing a vapor a predetermined quantity of volatile liquid;

metering means for metering the predetermined quantity of volatile liquid to the vaporizing means; and standpipe means for directing the vapor to the pumping chamber.

14. The heat-powered water punp defined in claim 13 wherein the outlet means comprises an upwardly oriented surge chamber superimposed over said second check valve means and the second check valve means comprises a horizontally disposed valve body adapted to rest under gravity on a valve seat, the surge chamber holding a residual amount of water over the valve body thereby assisting in sealing the valve body to the valve seat.

15. The heat-powered water pump defined in claim 13 wherein the pumping chamber comprises a downwardly opening enclosure, the opening providing fluid communication with the pumping reservoir.

16. The heat-powered water pump defined in claim 15 wherein the enclosure further comprises an insulative layer on the upper surfaces of the pumping chamber.

17. The heat-powered water pump defined in claim 13 wherein the vaporizing means comprises a heat storage and exchanger means.

18. The heat-powered water pump defined in claim 17 wherein the heat exchanger means comprises a block of metal with a cavity formed therein for receipt of volatile liquid from the metering means.

19. The heat-powered water pump defined in claim 18 wherein the metering means comprises a distributor for distributing the volatile liquid to the surface of the cavity.

20. The heat-powered water pump defined in claim 18 wherein the heat exchanger means is spaced from the pumping chamber and is adapted to be placed in thermal contact with a heat source.

21. The heat-powered water pump defined in claim 13 wherein the metering means comprises a metering cup and a siphon tube, the metering cup being mounted inside the pumping chamber adjacent the upper end thereof with the siphon tube inserted in the metering cup so as to drain the metering cup of volatile liquid upon filling of the metering cup to a level above the siphon tube, the siphon tube directing the siphoned volatile liquid to the vaporizing means.

22. The heat-powered water pump defined in claim 21 wherein the metering cup is mounted to the standpipe means and the siphon tube passes through the standpipe means to the vaporizing means.

23. The heat-powered water pump defined in claim 13 wherein the standpipe means comprises a vertically oriented pipe extending between the upper end of the pumping chamber and the vaporizing means.

24. A method for pumping water comprising:

forming a pumping chamber with a downwardly oriented opening;

interconnecting a reservoir chamber with the downwardly oriented opening of the pumping chamber;

providing inlet check valve means and outlet check valve means to the reservoir chamber, the inlet check valve means being in fluid communication with a water source;

fabricating a vaporizing means having a predetermined heat capacity to accommodate vaporizing a predetermined quantity of volatile liquid distributed thereto;

heating the vaporizing means;

metering a predetermined quantity of volatile liquid to the vaporizing means thereby generating a vapor;

displacing water from the reservoir chamber through the outlet check valve means by delivering the vapor to the pumping chamber and forcing water from the pumping chamber with the vapor; and replacing water in the reservoir chamber and the pumping chamber by condensing the vapor in the pumping chamber thereby creating a partial vacuum in the pumping chamber and causing atmospheric pressure to force water from the water source through the inlet check valve means.

25. The method defined in claim 24 wherein the metering step comprises placing a metering cup in the pumping chamber and a siphon tube in the metering cup, the metering cup filling during the replacing step and the siphon tube draining the metering cup after the predetermined quantity of volatile liquid has entered the metering cup.

26. The method defined in claim 24 wherein the metering step further comprises placing a predetermined quantity of a volatile liquid selected from the group consisting of cyclopentane and hexane over the water in the pumping chamber thereby providing a non-water volatile liquid for the vaporizing means.

* * * * *